US006317912B1

(12) United States Patent
Graebe et al.

(10) Patent No.: US 6,317,912 B1
(45) Date of Patent: Nov. 20, 2001

(54) BED MATTRESS WITH AIR CELLS AND SPRING POCKETS

(76) Inventors: Kurtis F. Graebe, 29 Lakewood, Belleville, IL (US) 62223; Randy M. Marling, 117 Longmead St., O'Fallon, IL (US) 62269

( * ) Notice: Subject to any disclaimer, the term of this patent is extended or adjusted under 35 U.S.C. 154(b) by 0 days.

(21) Appl. No.: 09/521,287

(22) Filed: Mar. 8, 2000

(51) Int. Cl.[7] ..... A47C 27/04; A47C 27/05; A47C 27/10; A47C 27/18

(52) U.S. Cl. ..... 5/710; 5/713; 5/720; 5/738; 5/739; 5/655.3; 5/655.8

(58) Field of Search ..... 5/710, 713, 716, 5/717, 720, 727, 738, 739, 654, 655.3, 655.7, 655.8, 655.9, 657, 657.5, 935

(56) References Cited

U.S. PATENT DOCUMENTS

| | | | | |
|---|---|---|---|---|
| 1,892,679 | * | 1/1933 | Penner et al. | 5/738 X |
| 1,915,659 | * | 1/1933 | Gail | 5/717 |
| 1,925,766 | * | 9/1933 | Lofman | 5/717 |
| 2,236,007 | * | 3/1941 | Oldman | 5/720 X |
| 2,279,886 | * | 4/1942 | Fuchs | 5/738 |
| 2,715,435 | * | 8/1955 | Rymland | 267/93 |
| 2,814,053 | * | 11/1957 | Sevcik | 5/710 |
| 3,046,574 | * | 7/1962 | Erenberg et al. | 5/717 |
| 3,064,280 | * | 11/1962 | Nachman, Jr. | 5/717 |
| 3,082,438 | * | 3/1963 | Nachman, Jr. | 5/717 |
| 3,192,540 | * | 7/1965 | Swank | 5/655.3 |
| 3,428,974 | * | 2/1969 | Stuart | 5/710 |
| 3,605,145 | * | 9/1971 | Greabe | 5/706 |
| 3,869,739 | * | 3/1975 | Klein | 5/720 |
| 3,870,450 | * | 3/1975 | Graebe | 425/269 |
| 3,950,800 | * | 4/1976 | Garshfield | 5/738 |
| 4,005,236 | * | 1/1977 | Graebe | 428/172 |
| 4,224,706 | * | 9/1980 | Young et al. | 5/710 |
| 4,234,984 | * | 11/1980 | Stumpf | 5/655.8 |
| 4,306,322 | * | 12/1981 | Young et al. | 5/710 |
| 4,357,724 | * | 11/1982 | Laforest | 5/706 |
| 4,388,738 | * | 6/1983 | Wagner | 5/738 X |
| 4,394,784 | | 7/1983 | Swenson et al. | 5/710 |
| 4,424,600 | * | 1/1984 | Callaway | 5/710 |
| 4,435,864 | * | 3/1984 | Callaway | 5/710 X |
| 4,449,261 | * | 5/1984 | Magnusson | 5/722 |
| 4,451,946 | * | 6/1984 | Stumpf | 5/655.8 |
| 4,490,866 | * | 1/1985 | Stanton | 5/738 X |
| 4,523,344 | * | 6/1985 | Stumpf et al. | 5/655.8 |
| 4,541,136 | * | 9/1985 | Graebe | 5/655.3 |
| 4,578,834 | * | 4/1986 | Stumpf | 5/720 |
| 4,698,864 | * | 10/1987 | Graebe | 5/654 |
| 4,947,500 | * | 8/1990 | Seiler | 5/713 |
| 4,951,335 | | 8/1990 | Eady | 5/709 |
| 4,982,466 | * | 1/1991 | Higgins et al. | 5/713 |
| 4,991,244 | | 2/1991 | Walker | 5/400 |
| 4,998,310 | | 3/1991 | Olson | 5/710 |
| 5,016,305 | * | 5/1991 | Suenens et al. | 5/655.8 |
| 5,052,068 | * | 10/1991 | Graebe | 5/654 |
| 5,065,485 | * | 11/1991 | Zocco | 5/738 X |
| 5,090,076 | * | 2/1992 | Guldager | 5/713 |
| 5,129,115 | | 7/1992 | Higgins et al. | 5/713 |
| 5,152,023 | * | 10/1992 | Graebe | 5/655.3 |
| 5,170,522 | | 12/1992 | Walker | 5/615 |
| 5,249,318 | * | 10/1993 | Loadsman | 5/710 |
| 5,259,079 | * | 11/1993 | Visser et al. | 5/716 X |
| 5,509,154 | | 4/1996 | Shafer et al. | 5/713 |

(List continued on next page.)

*Primary Examiner*—Robert G. Santos
(74) *Attorney, Agent, or Firm*—Howell & Haferkamp LC

(57) ABSTRACT

A composite mattress is comprised of a rectangular intermediate base with four upper sidewalls extending vertically above the base adjacent the edges of the base forming an upper cavity, four lower sidewalls extending vertically below the base adjacent the edges of the base forming a lower cavity, a spring mattress comprised of a plurality of coil springs individually encased within material pockets positioned in the lower cavity below the base, an air mattress comprised of a plurality of adjustable air cell units formed with independent air cells positioned in the upper cavity above the base, and a cover encasing the entire composite mattress.

37 Claims, 4 Drawing Sheets

U.S. PATENT DOCUMENTS

| | | | | |
|---|---|---|---|---|
| 5,513,401 | * | 5/1996 | Abe et al. | 5/716 X |
| 5,513,402 | * | 5/1996 | Schwartz | 5/691 |
| 5,561,875 | | 10/1996 | Graebe | 5/423 |
| 5,564,140 | | 10/1996 | Shoenhair et al. | 5/400 |
| 5,596,781 | | 1/1997 | Graebe | 5/710 |
| 5,621,935 | * | 4/1997 | St. Clair | 5/720 |
| 5,642,546 | | 7/1997 | Shoeehair | 5/680 |
| 5,647,077 | * | 7/1997 | Abe et al. | 5/685 |
| 5,652,484 | | 7/1997 | Shafer et al. | 318/16 |
| 5,765,246 | | 6/1998 | Shoenhair | 5/680 |
| 5,794,289 | * | 8/1998 | Wortman et al. | 5/713 |
| 5,926,883 | * | 7/1999 | Rechin et al. | 5/713 |
| 5,987,678 | * | 11/1999 | Ayers | 5/716 X |
| 6,061,855 | * | 5/2000 | Flick | 5/713 |
| 6,101,653 | * | 8/2000 | England | 5/738 |
| 6,145,142 | * | 11/2000 | Rechin et al. | 5/713 X |
| 6,243,900 | * | 6/2001 | Gladney et al. | 5/720 |

* cited by examiner

BED MATTRESS WITH AIR CELLS AND SPRING POCKETS

BACKGROUND OF THE INVENTION (i) Field of the Invention

The present invention relates in general to cushioning devices, and particularly to a combination mattress comprised of an air cell mattress and a spring mattress. The air cell mattress provides a uniform supporting force and the spring mattress provides deformation of the sleeping surface for comfort. Additionally, the air pressure of the air cell mattress is adjustable for added comfort.

(ii) Description of the Related Art

Various attempts have been made over the years to create a mattress that provides the utmost comfort and therapeutic care for a user. These attempts include the use of springs or air cells as key components of the mattress. Traditional mattresses are made from a combination of springs and padding encased in or surrounded by some form of cover. Mattresses have also been comprised of a plurality of air cells or air pockets surrounded by some type of cover that is typically padded.

The traditional spring mattress is typically comprised of a plurality of coil springs arranged in a rectangular pattern. The coil springs are encased within a padded cover and form a continuous surface upon which a person may rest. Spring mattresses support a person by the individual springs compressing proportionally to the force being exerted by the user on that spring. When compressed, the springs will exert an upward or supporting force on the user proportionate to the compression. When a user is on a spring mattress, the heavier portions of the user's body will exert a greater force on the springs supporting that portion of the body thereby causing a greater compression of the springs at those locations. Therefore, a user lying on a spring mattress will experience a larger pressure or supporting force below the heavier parts of their body as opposed to the supporting forces being experienced on the lighter portions of their body. This results in an uneven weight distribution on the spring mattress and concentrations of greater force along the user's body beneath the heavier portions of the user than beneath the lighter portions of the user.

The differential pressure experienced along a user's body is a drawback to conventional spring mattresses. If a user were to be required to be in a recumbent position on a conventional spring mattress for an extended period of time such concentrations of force and pressure would decrease the blood flow in the capillaries of that portion of the body and result in discomfort, soreness, or possibly bed sores. Additionally, because a user's weight is not evenly distributed over the spring mattress, certain sections of the spring mattress and the springs below these sections will repeatedly experience significantly larger compressions than other areas of the spring mattress and subsequently wear out sooner and thus limit the useful life of the mattress.

Air mattresses have been utilized to avoid the concentration of supporting forces on a user's body that are caused by spring mattresses. Typical air mattresses are comprised of a plurality of air cells. The air cells contain a fixed volume of air and when a user lies on an air mattress, the air pressure in the individual air cells will increase in proportion to the weight of the user being supported by the air cell and be distributed evenly throughout the air cell. Therefore, a user would experience a uniform supporting force over the surface of the air cell on which they are lying. Depending upon the size of the air cell, the pressure could be distributed over a large area of a user's body or concentrated on a small area like with a spring mattress.

Some air mattresses allow the user to adjust the amount of air within the air mattress. Typically, this type of mattress allows the user to add air to or remove air from the air cells of the air mattress either manually or with the use of an air pump. The custom adjusting of the air pressure within the air mattress allows the user to adjust the air mattress to achieve personalized comfort.

Some air mattresses divide the plurality of air cells up into zones. In this type of air mattress, all of the air cells within a zone are interconnected so that the air within the air cells freely moves between the air cells within that zone. The air cells within a zone, therefore, are at a uniform pressure and the supporting force experienced by a user's body is evenly distributed throughout the zone and the problem of concentrations of pressure on a user's body is avoided.

When an air mattress is divided into zones, the zones are typically independent of one another and do not communicate. The different zones will be positioned within the mattress to support different portions of a user's body, such as the head/shoulder area, the hip/torso area, or the feet/lower leg area. Because the zones are independent, they can be inflated to different pressures. Therefore, each zone can be custom inflated to provide user specific levels of comfort. A user can inflate any zone that supports a heavier part of the body to a higher pressure. Therefore, when the heavier part of the body is lying on that zone, the user will experience less deformation of the air cells within that zone as the weight of the body is evenly distributed throughout the zone. By inflating the zones of the air mattress to differing pressures, the user can alter the amount of deformation of the various zones.

However, the air cells of an air mattress have a maximum volume determined by their dimensions. Because the air cells have a maximum volume, the amount of deformation of the air mattress when supporting a user is limited by the amount of air pressure within the air cells, the number of air cells in communication, and the limited elasticity of the air cell walls. The larger the number of independent air cells within an air mattress the greater the variety of deformations and resulting comfort that can be experienced by a user and the closer the air mattress approximates a spring mattress. However, as the number of independent air cells within an air mattress increases, the ability to distribute the supporting forces over a large area of the user is diminished. Additionally, as the number of independent air cells increases the complexity and difficulty in providing individual control of the air pressure in the independent air cells increases thereby increasing costs and user difficulty.

Therefore, the air mattress must compromise between providing a uniform supporting force over a large area, and providing the flexibility of numerous deformations like a spring mattress.

SUMMARY OF THE INVENTION

The present invention overcomes shortcomings of prior art spring mattresses and air cell mattress by providing a combination mattress that includes the best features of a spring mattress along with the best features of an air mattress. Furthermore, in the combination air cell and spring mattress of the invention the air mattress is divided into zones that can have their pressures selectively controlled by the user to enable the most comfortable sleeping experience.

The combination air cell and spring mattress of the invention is comprised of a rectangular intermediate base that is made of a very soft yet durable material such as foam rubber or other similar material. The intermediate base has top and bottom surfaces and respective upper and lower sidewalls. The upper and lower sidewalls are constructed of a flexible yet rigid and resilient material such as foam rubber and are typically more rigid than the intermediate base. The upper sidewalls are positioned adjacent the peripheral edges of the intermediate base top surface and extend upwardly from the edges to a common vertical height above the top surface, thereby forming an upper cavity between the upper sidewalls and the top surface of the intermediate base. The lower sidewalls are positioned adjacent the peripheral edges of the intermediate base bottom surface and extend downwardly from the edges to a common vertical height below the bottom surface, thereby forming a lower cavity between the lower sidewalls and the bottom surface of the intermediate base.

The spring mattress is comprised of a plurality of springs and is positioned in the lower cavity below the bottom surface of the intermediate base. The air cell mattress is comprised of a plurality of air cells and is positioned in the upper cavity above the top surface of the intermediate base. The spring mattress, the lower sidewalls, the intermediate base, the upper sidewalls, and the air cell mattress are enclosed within a padded cover.

In the preferred embodiment, the spring mattress is comprised of a plurality of coil springs. The coil springs are each individually enclosed in a pocket of flexible material and the pockets are connected to each other, thereby forming the spring mattress. The spring mattress has a layer of material covering the bottom of the spring mattress and a layer of material covering the top of the spring mattress.

In the preferred embodiment, the air cell mattress is comprised of a plurality of air cell units that are each constructed of a generally flat air impervious base sheet and an air impervious top sheet. The air impervious top sheet is preformed with a plurality of air cells and is secured to the base sheet with the air cells extending outwardly from the base sheet. The air cells in each air cell unit are interconnected to permit air flow between the air cells and each air cell unit has a port so that air may be added to or removed from the air cell unit. The air cells of the air cell units are preferably cubic in shape with a domed top that extends above the common vertical height of the upper sidewalls. The number of air cell units utilized is determined by the capacity/size of the mattress. While any number of air cell units can be utilized, preferably there are three air cell units for each expected user of the combination mattress. For example, a twin or double size combination mattress would preferably contain three air cell units while a queen or king size combination mattress would preferably contain six air cell units. The air cell units are releasably connected to each other via fasteners and are positioned side-by-side above the intermediate base top surface. The use of three air cell units for each expected user is to provide support for three different portions of a user's body. The first air cell unit is designed and positioned to support the feet and legs of the user, the second air cell unit is designed and positioned to support the head/shoulders of the user, and the third air cell unit is designed and positioned to support the hips/torso of the user. Likewise forth, fifth and sixth air cell units are employed to support the other user of the combination mattress.

The port of the first and forth air cell units have integral valves that are manually opened and closed. The air pressure of the first and forth air cell units is controlled by the user and is separate from the air pressure of the second, third, fifth and sixth air cell units. The second and third air cell units communicate with each other via a common conduit or tube connected to their ports and to a remotely controlled air pump. The fifth and sixth air cell units communicate with each other via a common conduit or tube connected to their ports and to the remotely controlled air pump. The user can then remotely adjust the air pressure within the second and third or the fifth and sixth air cell units, thereby controlling the amount of deformation that would be experienced upon laying on the mattress.

In the preferred embodiment, the cover is comprised of an upper section and a lower section that are connected by a closure mechanism that can be selectively opened and closed. The lower section covers the spring mattress, the lower sidewalls, the intermediate base, and the upper sidewalls while the upper section is padded and covers the air cell mattress. Preferably, the upper and lower sections of the cover are releasably connected on three sides by a zipper and are sewn together on the fourth side.

The combination mattress of the present invention overcomes the disadvantages of the prior art. The use of an adjustable air cell mattress comprised of a plurality of air cells allows the user to experience a uniform supporting force distributed over a large area of the body above the different air cell units, while the use of a spring mattress beneath the very soft intermediate base and air cell mattress enables the user to experience the variety of proportional deformations of the mattress surface due to the compression of the individual coil springs. Therefore, the user experiences the benefits of an air cell mattress and the benefits of a spring mattress while minimizing the drawbacks of using an air cell mattress or a spring mattress individually.

BRIEF DESCRIPTION OF DRAWINGS

Further objectives and features of the present invention are set forth in the following detailed description of the preferred embodiment of the invention and in the drawing figures wherein.

DETAILED DESCRIPTION OF THE INVENTION

Figure 1:
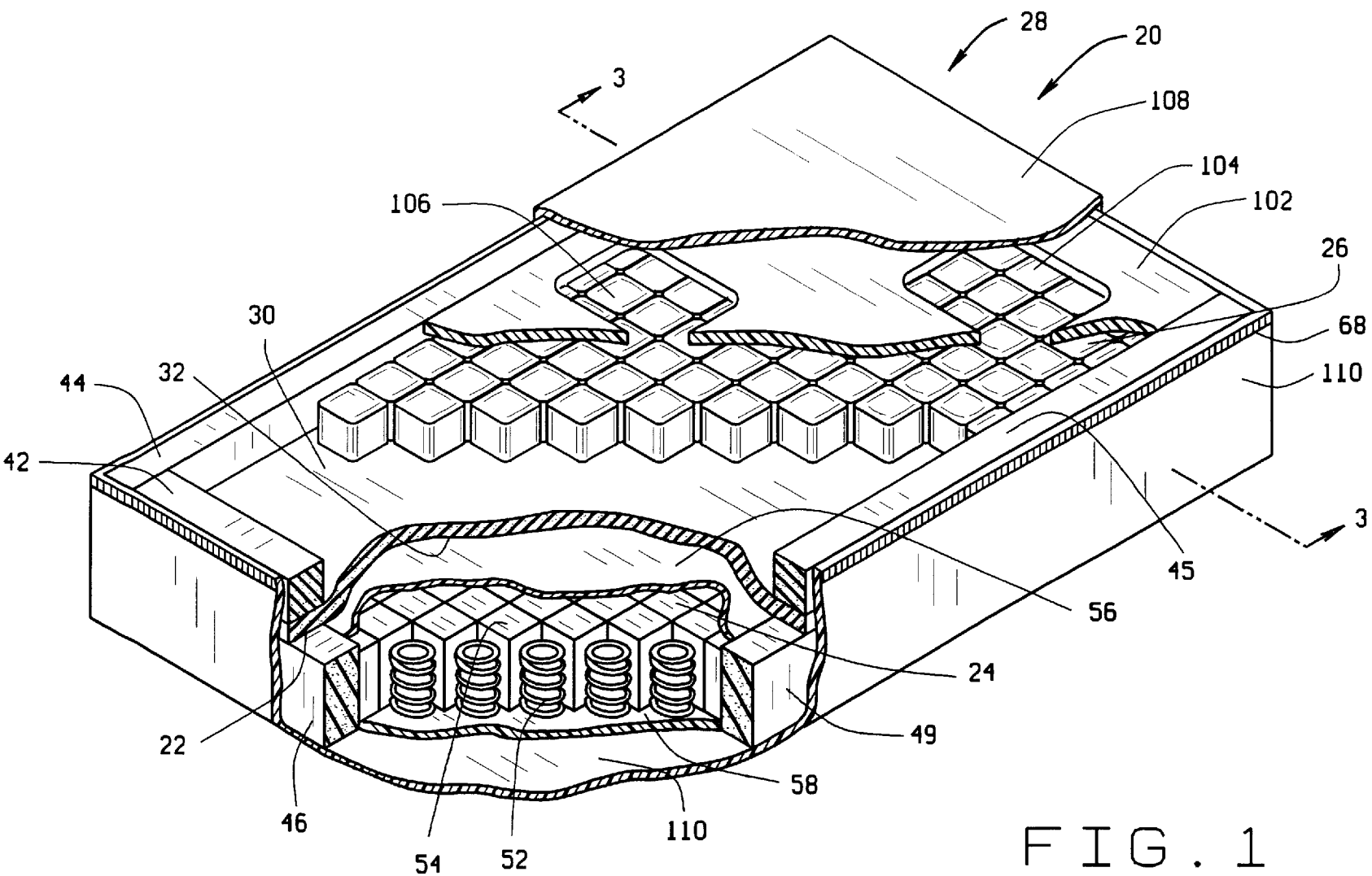
FIG. 1 is a perspective, partially cut-away view of the composite mattress.

FIG. 1 shows the components of the composite mattress 20. The composite mattress 20 is basically comprised of a rectangular intermediate base 22, a spring mattress 24, an air cell mattress 26 and a cover 28.

The intermediate base 22 has a top surface 30 and a bottom surface 32, a front edge 34 and a back edge 36 which define a longitudinal length of the intermediate base 22 therebetween, and a left edge 38 and a right edge 40 which define a lateral width of the intermediate base 22 therebetween. The intermediate base 22 has front and back upper sidewalls 42, 43 secured to the intermediate base top surface 30 adjacent the respective front and back edges 34, 36. The intermediate base 22 also has left and right upper sidewalls 44, 45 secured to the intermediate base top surface 30 adjacent the respective left and right edges 38,40. The front, back, left and right upper sidewalls 42, 43, 44, 45 extend upwardly from the top surface 30 of the intermediate base 22 to a common vertical dimension, thereby forming an upper cavity 50 within the upper sidewalls 42, 43, 44, 45 and above the top surface 30 of the intermediate base 22. The intermediate base 22 has front and back lower sidewalls 46, 47 secured to the intermediate base bottom surface 32 adjacent the respective front and back edges 34, 36. The intermediate base 22 also has left and right lower sidewalls 48, 49 secured to the intermediate base bottom surface 32 adjacent the respective left and right edges 38,40. The front, back, left and right lower sidewalls 46, 47, 48, 49 extend downwardly from the bottom surface 32 of the intermediate base 22 to a common vertical dimension, thereby forming a lower cavity 51 within the lower sidewalls 46, 47, 48, 49 and below the bottom surface 32 of the intermediate base 22. The intermediate base 22 is preferably constructed of a very soft yet durable material such as foam rubber or other similar material. The upper and lower sidewalls 42, 43, 44, 45 46, 47, 48, 49 are preferably constructed of a foam rubber that is more rigid than the foam rubber used in the intermediate base 22. Alternatively, the upper and lower sidewalls 42, 43, 44, 45 46, 47, 48, 49 can be made of material other than foam rubber as long as the material is flexible yet rigid. With the intermediate base positioned between the upper and lower sidewalls it functions to restrain the sidewalls against bowing outwardly when the mattress is being used.

The spring mattress 24 is positioned in the lower cavity 51 below the bottom surface 32 of the intermediate base 22. The spring mattress 24 is comprised of a plurality of springs, preferably coil springs 52, with each coil spring 52 being enclosed in a pocket of flexible material 54 such as cloth. The pockets of flexible material 54 completely envelope the springs 52 and are connected to one another and thereby connect the plurality of coil springs 52 to each other with the orientations of the springs 52 being the same. Alternatively or additionally, the coil springs 52 can be connected to one another by layers of material 56, 58 such as cloth being fixed to the opposite top and bottom ends of the pockets. Spring mattresses having coil springs enclosed in pockets are known in the art.

While the spring mattress 24 of the composite mattress 20 is preferably made of a plurality of coil springs 52 enclosed within pockets of flexible material 54, it is to be understood that any type of spring mattress can be utilized as the spring mattress component of the composite mattress 20.

Figure 4:
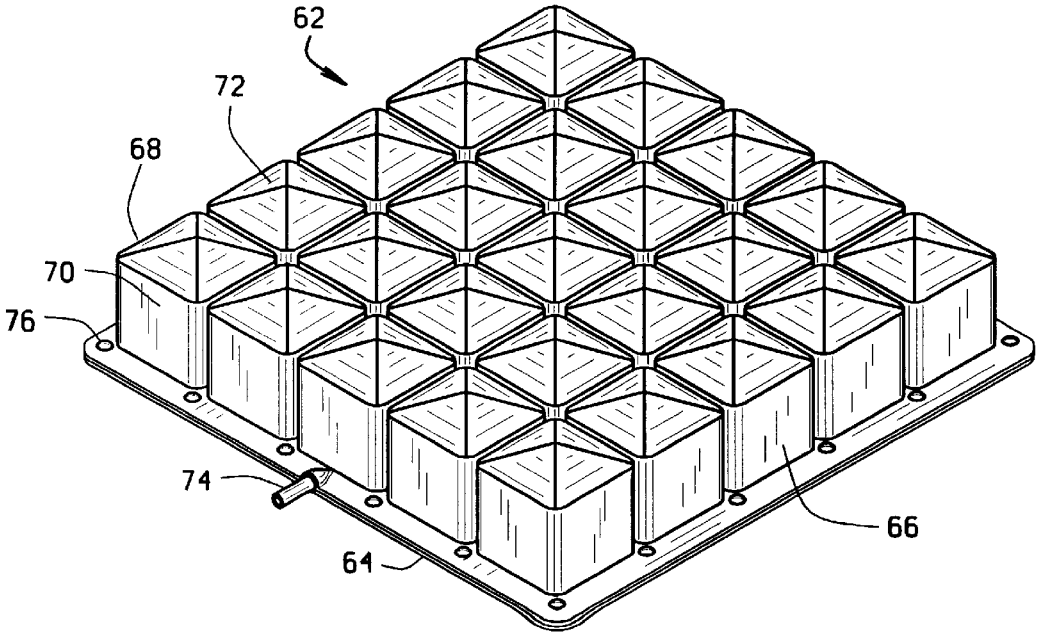
FIG. 4 is a perspective view of an individual air cell unit of the air cell mattress.
Figure 5:
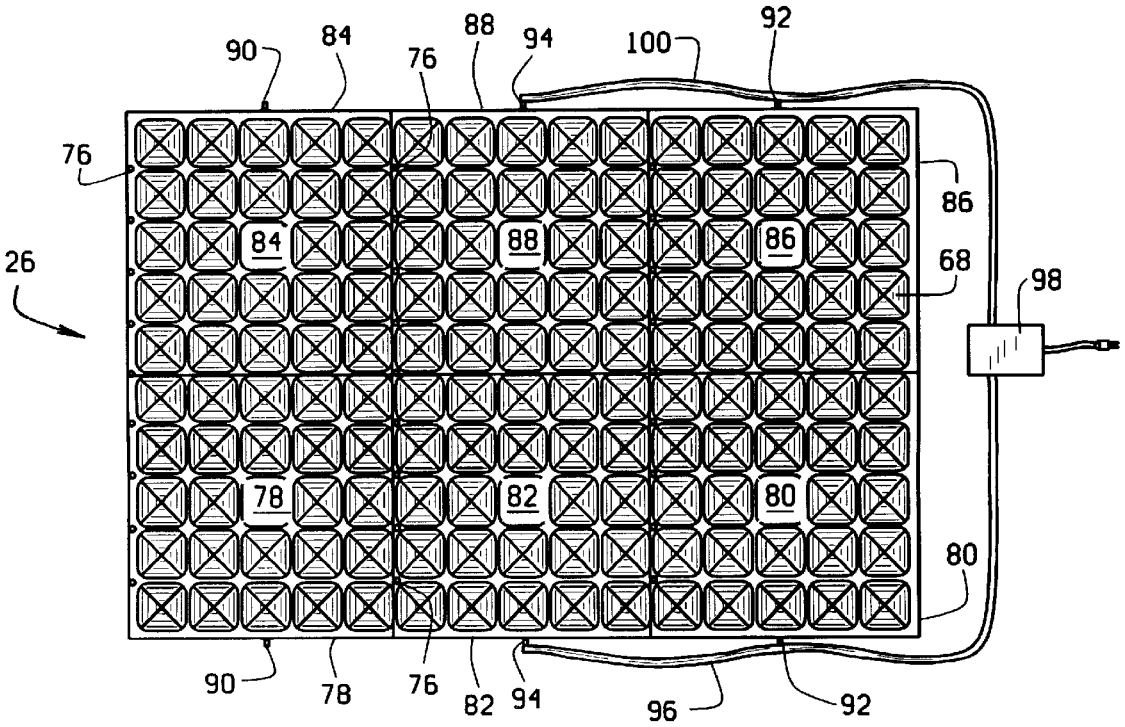
FIG. 5 is a plan view of the top of the air cell mattress in which the air cell mattress is divided into six air cell units.
Figure 6:
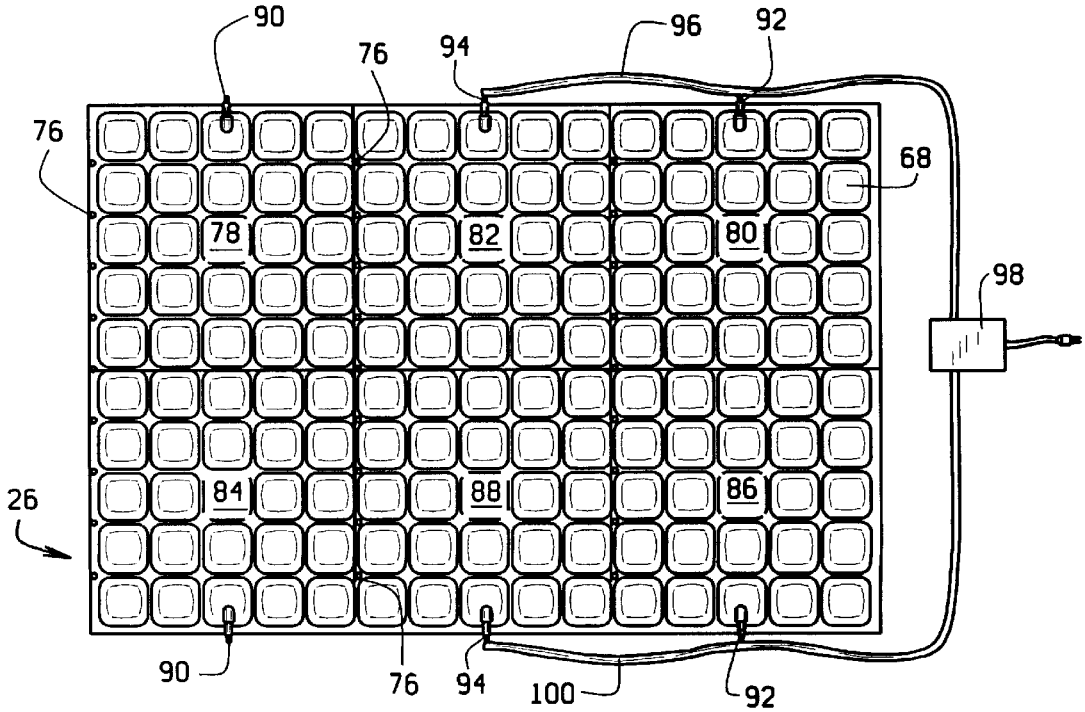
FIG. 6 is a plan view of the bottom of the air cell mattress in which the air cell mattress is divided into six air cell units.

The air cell mattress 26 is positioned within the upper cavity 50 above the top surface 30 of the intermediate base 22. Preferably, the air mattress 26, shown in FIGS. 5 and 6, is comprised of a plurality of air cell units 62 of the type shown in FIG. 4. Each air cell unit 62 is constructed in a similar manner to that of the air mattresses described in U.S. Pat. Nos. 5,561,875 and 5,596,781, incorporated herein by reference. Each air cell unit 62 is comprised of a generally flat base sheet 64 and a top sheet 66, each made from an air impervious material such as vinyl or plastic. The top sheet 66 is molded to form a plurality of air cells 68 and is fixed to the base sheet 64 around the bottom edges of the air cells 68, except for portions of the air cell bottom edges that are left open between the top sheet 66 and the base sheet 64. The left open portions of the air cell bottom edges communicate with internal air channels (not shown) left open between the top sheet 66 and the base sheet 64 that provide a path for airflow between the air cells 68. Each air cell 68 preferably has a generally cubical shape with four walls 70 extending outwardly from the base sheet 64. A triangular panel 72 extends from the top-most edge of each of the walls 70 and the triangular panels 72 come together to define a pyramidal-type or dome shaped surface at the top of each of the independent air cells 68. The triangular panels 72 that form the pyramidal-type shaped surface at the top of each of the air cells 68 extend vertically above the front, back, left and right upper sidewalls 42, 43, 44, 45. Each air cell unit 62 has a port 74 that communicates with all of the air cells of the unit and through which air can be added to or removed from the air cells. The air cell units 62 can be connected to one another via releasable fasteners 76, such as snaps or other types of fasteners which are provided on the perimeters of the sheets that comprise the air cell units 62. In the preferred embodiment, each air cell unit 62 is comprised of twenty-five air cells 68 which are arranged in a 5×5 configuration. However, it should be understood that the air cell units 62 can be comprised of any number of air cells 68 without deviating from the scope of this invention.

In the preferred embodiment, the air mattress 26, as shown in FIGS. 5 and 6, is comprised of six air cell units 78, 80, 82, 84, 86, 88. The first 78, second 80, and third 82 air cell units are arranged longitudinally side-by-side above the intermediate base top surface 30 along the right upper sidewall 45 and between the front upper sidewall 42 and the back upper sidewall 43. The first air cell unit 78 is positioned adjacent the front upper sidewall 42, the second air cell unit 80 is positioned adjacent the back upper sidewall 43, and the third air cell unit 82 is positioned between the first 78 and the second 80 air cell units. The fourth 84, fifth 86, and sixth 88 air cell units are arranged longitudinally side-by-side above the intermediate base top surface 30 along the left upper sidewall 44 and between the front upper sidewall 42 and the back upper sidewall 43. The fourth air cell unit 84 is positioned adjacent the front upper sidewall 42, the fifth air cell unit 86 is positioned adjacent the back upper sidewall 43, and the sixth air cell unit 88 is positioned between the fourth 84 and fifth 86 air cell units. This preferred embodiment, which is a queen size composite mattress 20, has three air cell units 62 for each of the two anticipated users of the composite mattress 20. In a single or twin sized composite mattress (not shown), where a single user is anticipated, the preferred embodiment would include three air cell units 62 for example the first, second, and third air cell units. Each air cell unit 62 can be independent of the other air cell units so that in a plurality of air cell units 62, each can have a different air pressure.

In the preferred embodiment, the first 78 and fourth 84 air cell units are intended and positioned to support the feet and lower legs of two users of the composite mattress 20 laying on the mattress. Likewise, the third 82 and sixth 88 air cell units are intended and positioned to support the hips and mid-region of two users laying on the composite mattress 20. The second 80 and fifth 86 air cell units are intended and positioned to support the head and shoulders of two users laying on the composite mattress 20. Adjacent edges of the first, second, third, fourth, fifth and sixth air cell units 78, 80, 82, 84, 86, 88 are releasably connected to one another by the releasable fasteners 76.

In the preferred embodiment, the first 78 and fourth 84 air cell units are independent of the other air cell units 80, 82, 86, 88 and each has a port and valve 90 which allows air to be added to or removed from each of the air cell units 78, 84. The second 80 and third 82 air cell units each have ports 92 and 94 through which air can be added to or removed from each air cell unit. The ports 92, 94 of the second 80 and third 82 air cell units are connected by a conduit 96 and communicate with one another through the conduit 96. The conduit 96 is preferably connected to a remotely controlled air pump 98. Air is added to or removed from the second 80 and third 82 air cell units by the remotely controlled air pump 98. Likewise, the fifth 86 and sixth 88 air cell units also have ports 92 and 94 through which air can be added to or removed from the air cell units. The ports 92, 94 of the fifth 86 and sixth 88 air cell units are connected by a conduit 100 and communicate with one another through the conduit 100. The conduit 100 is preferably connected to a remotely controlled air pump 98. Air is added to or removed from the fifth 86 and sixth 88 air cell units by the remotely controlled air pump 98. Preferably the pump 98 can be controlled to adjust the air pressure of the second 80 and third 82 air cell units independently of the air pressure of the fifth 86 and sixth 88 air cell units, and vice versa.

Therefore, in the preferred embodiment, the second 80 and third 82 air cell units will be at the same internal air pressure while supporting the head/shoulders and the hips/torso of a user laying on the right side of the composite mattress 20. Likewise, the fifth 86 and sixth 88 air cell units will be at a common internal air pressure while supporting the head/shoulders and hips/torso of a user laying on the left side of the composite mattress 20. In another embodiment, all six air cell units 78, 80, 82, 84, 86, 88 are independent of one another and do not communicate such that none of them are required to be at the same internal pressure as another.

Figure 2:
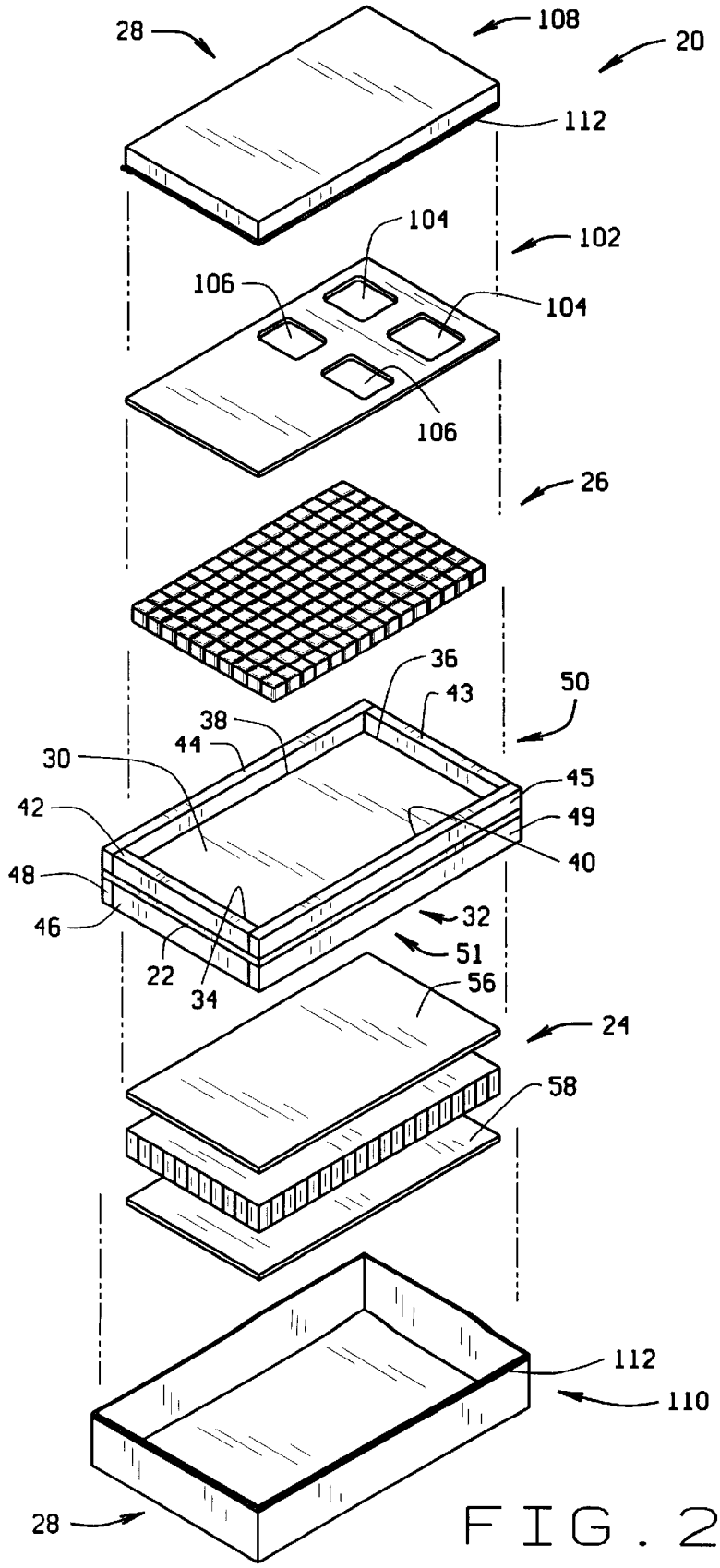
FIG. 2 is a perspective, exploded view of the composite mattress.
Figure 3:
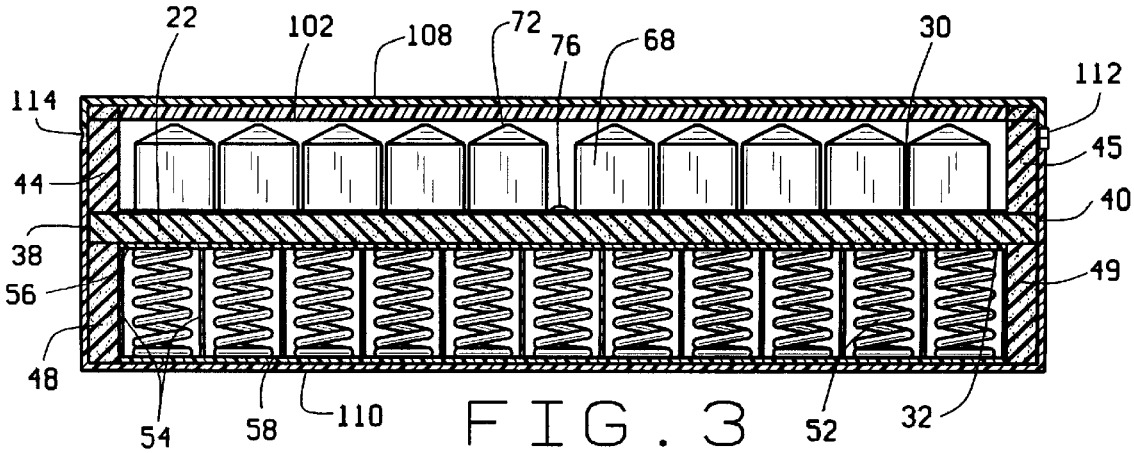
FIG. 3 is a cross-sectional end view of the composite mattress of FIG. 1 taken along line 3—3.

In the preferred embodiment, a layer of material having open areas or cut-outs 102 is positioned on top of the air mattress 26. The layer with cut-outs 102 is preferably made of a thin layer of flexible, padded material such that it provides support for a user and distributes a user's weight load over the air cells 68 while not providing any discomfort to the user of the composite mattress 20. The layer with cut-outs 102, when designed for a queen size bed as shown in FIG. 2, contains four cut-outs 104, 106. The pair of cut-outs 104 adjacent the back upper sidewall 43 of the mattress are designed and oriented to correspond with the head/shoulders regions of two users laying on the composite mattress 20. The pair of cut-outs outs 106 at the middle of the mattress are designed and oriented to correspond with the hips/torso regions of two users laying on the composite mattress 20. The cut-outs 104, 106 expose the air cells beneath the cut-outs and provide for a user to experience the maximum advantage of the air cell mattress 26 where a majority of the mass of their body resides.

In the preferred embodiment, the entire composite mattress 20 is encased within a rectangular cover 28. The cover 28 is comprised of an upper cover section 108 and a lower cover section 110. The lower cover section 110 fits around and encloses the spring mattress 24, the lower sidewalls 46, 47, 48, 49, the intermediate base 22 and the upper sidewalls 42, 43, 44, 45. The upper cover section 108 encloses the cut-out layer 102 and the portion of the air cell mattress 26 that extends above the upper sidewalls 42, 43, 44, 45. The upper cover section 108 and the lower cover section 110 are preferably attached to one another by a closure mechanism 112. In the preferred embodiment, the closure mechanism 112 is a zipper that runs along three adjoining sides of the upper and lower cover sections 108, 110 while the fourth side of the upper and lower cover sections 108, 110 are sewn together 114.

The upper cover section 108 preferably is made of a soft material such as cloth that allows for heat and moisture to be dissipated such that contact with the user results in a pleasing or pleasurable experience. The upper cover section 108 may also contain batting or padding such that a user of the composite mattress 20 is completely unaware of any discontinuities in the surface of the composite mattress 20 residing beneath the upper cover section 108. The lower cover section 110 is usually made of the same material as the upper section cover 108, but does not contain batting or padding as a user will not be laying on that side of the composite mattress 20.

In operation, the user of the composite mattress 20 adjusts the pressures of the various air cell units 78, 80, 82, 84, 86, 88 to achieve maximum individual comfort. The first 78 and forth 84 air cell units are not intended to be adjusted on a regular basis. A user, if desiring to adjust the pressure of the first 78 and forth 84 air cell units, would need to unzip the upper cover section 108 from the lower cover section 110 to gain access to the interior of the composite mattress 20 and to the air cell units. The user would then connect a manually operated bulb pump or similar device to the valves 90 and add air to or remove air from the air cell unit until the desired pressure is obtained.

The second 80 and third 82 air cell units are designed to be adjusted without requiring access to the interior of the composite mattress 20. The second 80 and third 82 air cell units communicate with one another through their common conduit 96 which extends outside the composite mattress 20 and is connected to a remotely controlled air pump 98. The remotely controlled air pump 98 allows the user to add or remove air until the desired pressurization and comfort is achieved in the second 80 and third 82 air cell units.

Likewise, the fifth 86 and sixth 88 air cell units are designed to be adjusted without requiring access to the interior of the composite mattress 20. The fifth 86 and sixth 88 air cell units communicate with one another through their common conduit 100 which extends outside the composite mattress 20 and is also connected to the remotely controlled air pump 98. The remotely controlled air pump 98 allows the user to add or remove air until the desired pressurization and comfort is achieved in the fifth 86 and sixth 88 air cell units. The second 80 and third 82 air cell units and the fifth 86 and sixth 88 air cell units do not communicate with one another and are controlled independently by the remotely controlled air pump 98. While the use of a remotely controlled air pump 98 is the preferred method, any type of pumping mechanism may be utilized to add to or remove air from the air cell units 62.

While the present invention has been described by reference to specific embodiments, it should be understood that modifications and variations of the invention may be constructed without departing from the scope of the invention as defined by the following claims.

What is claimed is:

1. A composite mattress comprising:

a spring mattress comprised of a plurality of springs, the spring mattress having opposite top and bottom surfaces, opposite front and back edges defining a longitudinal length of the spring mattress therebetween and opposite left and right edges defining a lateral width of the spring mattress therebetween;

an air cell mattress comprised of a plurality of air cells positioned above the top surface of the spring mattress, the air cell mattress is further comprised of at least one air impervious base sheet and at least one air impervious top sheet, the air impervious top sheet is preformed with the plurality of air cells and is secured to the base sheet with the air cells extending outwardly from the base sheet, the base sheet and top sheet forming an air cell unit and the air cells of the air cell unit are interconnected to permit air flow therebetween, the base sheet is generally flat and is positioned above the spring mattress with the plurality of air cells extending upwardly from the base sheet; and a cover enclosing the spring mattress and the air cell mattress.

2. The composite mattress of claim 1 wherein:

each spring of the plurality of springs is enclosed in a pocket of flexible material and the pockets are connected to each other.

3. The composite mattress of claim 2, wherein:

each spring of the plurality of springs is a coil spring.

4. The composite mattress of claim 1 wherein:

the air cell unit is one of a plurality of air cell units of the air cell mattress and the plurality of air cell units are positioned side-by-side above the spring mattress.

5. The composite mattress of claim 4, wherein:

the plurality of air cell units comprise three air cell units, the three air cell units are arranged longitudinally side-by-side across the spring mattress between the front edge and back edge, a first of the three air cell units is positioned adjacent the front edge, a second of the three air cell units is positioned adjacent the back edge, and a third of the three air cell units is positioned between the first and second air cell units.

6. The composite mattress of claim 4, wherein:

the plurality of air cell units comprise six air cell units, a first, second, and third of the six air cell units are arranged longitudinally side-by-side across the spring mattress along the right edge, the first air cell unit is positioned adjacent the front edge, the second air cell unit is positioned adjacent the back edge, and the third air cell unit is positioned between the first and second air cell units, a fourth, fifth, and sixth of the six air cell units are arranged longitudinally side-by-side across the spring mattress along the left edge, the fourth air cell unit is positioned adjacent the front edge, the fifth air cell unit is positioned adjacent the back edge, and the sixth air cell unit is positioned between the fourth and fifth air cell units.

7. The composite mattress of claim 1, wherein:

the cover is comprised of a lower section and an upper section, the lower section covers the bottom surface of the spring mattress and the front, back, left and right edges of the spring mattress and the upper section covers the air cell mattress and the upper and lower sections are connected together by a closure mechanism that can be selectively opened and closed.

8. A composite mattress comprising:

a spring mattress comprised of a plurality of springs, the spring mattress having opposite top and bottom surfaces, opposite front and back edges defining a longitudinal length of the spring mattress therebetween and opposite left and right edges defining a lateral width of the spring mattress therebetween;

an air cell mattress comprised of a plurality of air cells positioned above the top surface of the spring mattress, the air cell mattress is further comprised of at least one air impervious base sheet and at least one air impervious top sheet, the air impervious top sheet is preformed with the plurality of air cells and is secured to the base sheet with the air cells extending outwardly from the base sheet, the base sheet and top sheet forming an air cell unit and the air cells of the air cell unit are interconnected to permit air flow therebetween, the air cell unit is one of a plurality of air cell units of the air cell mattress and the plurality of air cell units are positioned side-by-side above the spring mattress, the plurality of air cell units comprise three air cell units, the three air cell units are arranged longitudinally side-by-side across the spring mattress between the front and back edge, a first of the three air cell units is positioned adjacent the front edge, a second of three air cell units is positioned adjacent the back edge, and a third of the three air cell units is positioned between the first and second air cell units, the first air cell unit has a valve that can be opened and closed to allow for air to be added to or removed from the first air cell unit and the second and third air cell units have a common valve that can be opened and closed to allow for air to be added to or removed from the second and third air cell units; and a cover enclosing the spring mattress and the air cell mattress.

9. A composite mattress comprising:

a rectangular intermediate base having opposite top and bottom surfaces, opposite front and back edges defining a longitudinal length of the intermediate base therebetween and opposite left and right edges defining a lateral width of the intermediate base therebetween;

front and back upper sidewalls secured to the intermediate base adjacent the respective front and back edges of the intermediate base and left and right upper sidewalls secured to the intermediate base adjacent the respective left and right edges of the intermediate base, the front, back, left and right upper sidewalls each having a common vertical height above the intermediate base top surface and together with the intermediate base defining an upper cavity within the upper sidewalls and above the intermediate base top surface;

a spring mattress comprised of a plurality of springs positioned below the bottom surface of the intermediate base;

an air cell mattress comprised of a plurality of air cells positioned in the upper cavity above the top surface of the intermediate base; and a cover enclosing the spring mattress, the intermediate base, the upper sidewalls, and the air cell mattress.

10. The composite mattress of claim 9, further comprising: front and back lower sidewalls secured to the intermediate base adjacent the respective front and back edges of the intermediate base and left and right lower sidewalls secured to the intermediate base adjacent the respective left and right edges of the intermediate base, the front, back, left and right lower sidewalls each having a common vertical height below the intermediate base bottom surface and together with the intermediate base defining a lower cavity within the lower sidewalls and below the intermediate base bottom surface;

the spring mattress is positioned in the lower cavity below the bottom surface of the intermediate base; and the cover encloses the spring mattress, the lower sidewalls, the intermediate base, the upper sidewalls, and the air cell mattress.

11. The composite mattress of claim 9, wherein:

each spring of the plurality of springs is enclosed in a pocket of flexible material and the pockets are connected to each other.

12. The composite mattress of claim 11, wherein:

each spring of the plurality of springs is a coil spring.

13. The composite mattress of claim 9, wherein:

the air cell mattress is further comprised of at least one air impervious base sheet and at least one air impervious top sheet, the air impervious top sheet is preformed with the plurality of air cells and is secured to the base sheet with the air cells extending outwardly from the base sheet, the base sheet and top sheet forming an air cell unit and the air cells of the air cell unit are interconnected to permit air flow therebetween.

14. The composite mattress of claim 13, wherein:

the base sheet is generally flat and is positioned above the intermediate base top surface with the plurality of air cells extending upwardly from the base sheet.

15. The composite mattress of claim 13, wherein:

the air cell unit is one of a plurality of air cell units of the air cell mattress and the plurality of air cell units are positioned side-by-side above the intermediate base top surface.

16. The composite mattress of claim 15, wherein:

the plurality of air cell units comprise three air cell units, the three air cell units are arranged longitudinally side-by-side across the intermediate base between the front upper sidewall and back upper sidewall, a first of the three air cell units is positioned adjacent the front upper sidewall, a second of the three air cell units is positioned adjacent the back upper sidewall, and a third of the three air cell units is positioned between the first and second air cell units.

17. The composite mattress of claim 16, wherein:

the first air cell unit has a valve that can be opened and closed to allow for air to be added to or removed from the first air cell unit and the second and third air cell units have a common valve that can be opened and closed to allow for air to be added to or removed from the second and third air cell units.

18. The composite mattress of claim 15, wherein:

the plurality of air cell units comprise six air cell units, a first, second and third of the six air cell units are arranged longitudinally side-by-side across the intermediate base along the right upper sidewall between the front upper sidewall and back upper sidewall, the first air cell unit is positioned adjacent the front upper sidewall, the second air cell unit is positioned adjacent the back upper sidewall, and the third air cell unit is positioned between the first and second air cell units, a fourth, fifth, and sixth of the six air cell units are arranged longitudinally side-by-side across the intermediate base along the left upper sidewall between the front upper sidewall and back upper sidewall, the fourth air cell unit is positioned adjacent the front upper sidewall, the fifth air cell unit is positioned adjacent the back upper sidewall, and the sixth air cell unit is positioned between the fourth and fifth air cell units.

19. The composite mattress of claim 9, wherein:

each air cell of the plurality of air cells is generally cubic shaped and has a top surface that is domed and extends above the common vertical height of the front, back, left and right upper sidewalls.

20. The composite mattress of claim 9, wherein:

the cover is comprised of a lower section and an upper section, the lower section covers the spring mattress, the intermediate base, and the front, back, left and right upper sidewalls and the upper section covers the air cell mattress and the upper and lower sections are connected together by a closure mechanism that can be selectively opened and closed.

21. The composite mattress of claim 9, wherein:

the intermediate base is constructed of a foam padding.

22. The composite mattress of claim 9, wherein:

the front, back, left and right upper and lower sidewalls are all constructed of a foam padding.

23. A composite mattress comprising:

a rectangular intermediate base having opposite top and bottom surfaces, opposite front and back edges defining a longitudinal length of the intermediate base therebetween and opposite left and right edges defining a lateral width of the intermediate base therebetween;

front and back lower sidewalls secured to the intermediate base adjacent the respective front and back edges of the intermediate base and left and right lower sidewalls secured to the intermediate base adjacent the respective left and right edges of the intermediate base, the front, back, left and right lower sidewalls each having a common vertical height below the intermediate base bottom surface and together with the intermediate base defining a lower cavity within the lower sidewalls and below the intermediate base bottom surface;

a spring mattress comprised of a plurality of springs positioned in the lower cavity below the bottom surface of the intermediate base;

an air cell mattress comprised of a plurality of air cells positioned above the top surface of the intermediate base; and a cover enclosing the spring mattress, the lower sidewalls, the intermediate base, and the air cell mattress.

24. The composite mattress of claim 23 further comprising: front and back upper sidewalls secured to the intermediate base adjacent the respective front and back edges of the intermediate base and left and right upper sidewalls secured to the intermediate base adjacent the respective left and right edges of the intermediate base, the front, back, left and right upper sidewalls each having a common vertical height above the intermediate base top surface and together with the intermediate base defining an upper cavity within the upper sidewalls and above the intermediate base top surface;

the air cell mattress is positioned in the upper cavity above the top surface of the intermediate base; and the cover encloses the spring mattress, the lower sidewalls, the intermediate base, the upper sidewalls, and the air cell mattress.

25. The composite mattress of claim 24, wherein:

each air cell of the plurality of air cells is generally cubic shaped and has a top surface that is domed and extends above the common vertical height of the front, back, left and right upper sidewalls.

26. The composite mattress of claim 23, wherein:

each spring of the plurality of springs is enclosed in a pocket of flexible material and the pockets are connected to each other.

27. The composite mattress of claim 26, wherein:

each spring of the plurality of springs is a coil spring.

28. The composite mattress of claim 23, wherein:

the air cell mattress is further comprised of at least one air impervious base sheet and at least one air impervious top sheet, the air impervious top sheet is preformed with the plurality of air cells and is secured to the base sheet with the air cells extending outwardly from the base sheet, the base sheet and top sheet forming an air cell unit and the air cells of the air cell unit are interconnected to permit air flow therebetween.

29. The composite mattress of claim 28, wherein:

the base sheet is generally flat and is positioned above the intermediate base top surface with the plurality of air cells extending upwardly from the base sheet.

30. The composite mattress of claim 28, wherein:

the air cell unit is one of a plurality of air cell units of the air cell mattress and the plurality of air cell units are positioned side-by-side above the intermediate base top surface.

31. The composite mattress of claim 30, wherein:

the plurality of air cell units comprise three air cell units, the three air cell units are arranged longitudinally side-by-side across the intermediate base between the front edge and back edge, a first of the three air cell units is positioned adjacent the front edge, a second of the three air cell units is positioned adjacent the back edge, and a third of the three air cell units is positioned between the first and second air cell units.

32. The composite mattress of claim 31, wherein:

the first air cell unit has a valve that can be opened and closed to allow for air to be added to or removed from the first air cell unit and the second and third air cell units have a common valve that can be opened and closed to allow for air to be added to or removed from the second and third air cell units.

33. The composite mattress of claim 30, wherein:

the plurality of air cell units comprise six air cell units, a first, second and third of the six air cell units are arranged longitudinally side-by-side across the intermediate base along the right edge between the front edge and back edge, the first air cell unit is positioned adjacent the front edge, the second air cell unit is positioned adjacent the back edge, and the third air cell unit is positioned between the first and second air cell units, a fourth, fifth, and sixth of the six air cell units are arranged longitudinally side-by-side across the intermediate base along the left edge between the front edge and back edge, the fourth air cell unit is positioned adjacent the front edge, the fifth air cell unit is positioned adjacent the back edge, and the sixth air cell unit is positioned between the fourth and fifth air cell units.

34. The composite mattress of claim 23, wherein:

each air cell of the plurality of air cells is generally cubic shaped and has a top surface that is domed.

35. The composite mattress of claim 23, wherein:

the cover is comprised of a lower section and an upper section, the lower section covers the spring mattress, the front, back, left and right lower sidewalls, and the intermediate base and the upper section covers the air cell mattress and the upper and lower sections are connected together by a closure mechanism that can be selectively opened and closed.

36. The composite mattress of claim 23, wherein:

the intermediate base is constructed of a foam padding.

37. The composite mattress of claim 23 wherein:

the front, back, left and right lower sidewalls are constructed of a foam padding.

* * * * *